United States Patent [19]

Herst et al.

[11] 4,390,930

[45] Jun. 28, 1983

[54] INDIRECT LIGHTING FIXTURE WITH IMPROVED LIGHT CONTROL

[75] Inventors: Douglas J. Herst, Ross; Peter Y. Y. Ngai, Danville, both of Calif.

[73] Assignee: Herst Lighting Co., Berkeley, Calif.

[21] Appl. No.: 254,462

[22] Filed: Apr. 15, 1981

[51] Int. Cl.[3] ..... F21S 3/0

[52] U.S. Cl. ..... 362/224; 362/223; 362/260; 362/309; 362/311; 362/328; 362/337; 362/338; 362/340; 362/367

[58] Field of Search ..... 362/223, 224, 260, 307, 362/308, 309, 311, 327, 328, 329, 335, 336, 337, 338, 340, 367

[56] References Cited

U.S. PATENT DOCUMENTS

| | | | |
|---|---|---|---|
| 2,348,930 | 5/1944 | Schepmoes | 362/224 |
| 2,474,341 | 6/1949 | Wince | 362/224 |
| 2,583,939 | 1/1952 | French | 362/223 |
| 2,741,694 | 4/1956 | Thomstad | 362/340 |
| 2,977,460 | 3/1961 | Franck | 362/309 |
| 3,132,813 | 5/1964 | Izzi | 362/224 |

*Primary Examiner*—Donald P. Walsh
*Attorney, Agent, or Firm*—Bruce & McCoy

[57] ABSTRACT

A long, linear indirect lighting fixture of a relatively small cross-sectional dimension which is mounted above eye level is comprised of lamps secured within an elongated housing, and a reflector and side lenses which direct and refract the greatest portion of luminous flux from the lamps above the horizontal plane of the fixture, yet a small portion of the luminous flux below but near the horizontal plane. The portion of light directed below but near the horizontal plane, which is controlled by, among other things, the relative placement of the lens and lamps, is great enough for an individual to have a perception of seeing a light source but small enough to avoid discomfort produced by glare.

18 Claims, 6 Drawing Figures

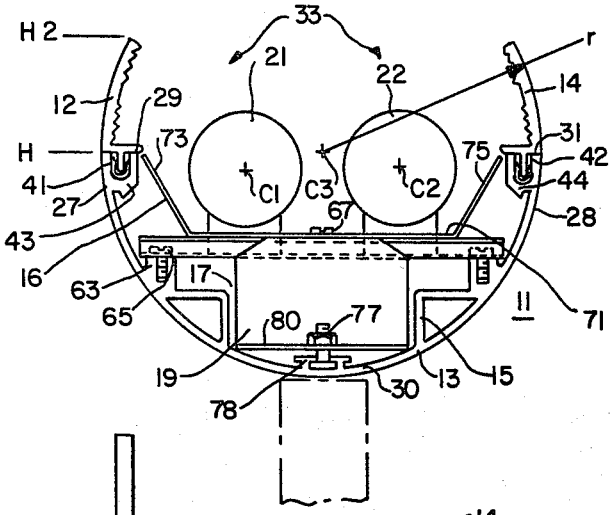
FIG.-1
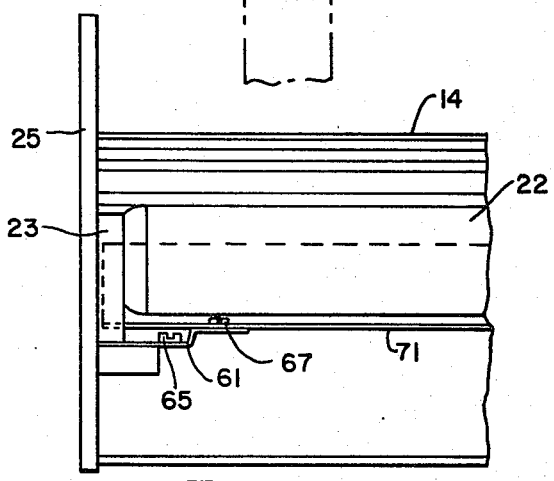
FIG.-2
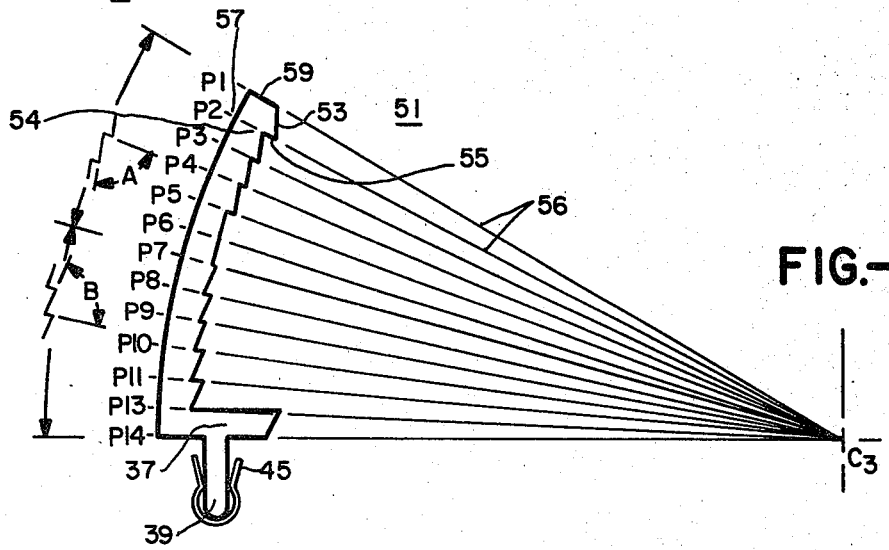
FIG.-3
| PRISM | ANGLE | DEG | PRISM | ANGLE | DEG. |
|---|---|---|---|---|---|
| 1 | A | 65 | 8 | B | 81 |
| 2 | A | 71 | 9 | B | 76 |
| 3 | A | 76 | 10 | B | 72 |
| 4 | A | 81 | 11 | B | 68 |
| 5 | A | 86 | 12 | B | 63 |
| 6 | A | 90 | 13 | B | 59 |
| 7 | — | — | | | |
FIG.-4

2-40W-F-T12-RS CW RATED 330 LUMENS EACH

| LUMINAIRE DISTRIBUTION DATA | | | | | |
|---|---|---|---|---|---|
| MID-ZONE ANGLE | 90° A | 67 1/2° E | 45° C | 22 1/2° D | 0° B |
| 180 | 1713 | 1713 | 1713 | 1713 | 1713 |
| 175 | 1766 | 1762 | 1743 | 1713 | 1705 |
| 170 | 1814 | 1827 | 1799 | 1720 | 1690 |
| 165 | 1814 | 1827 | 1806 | 1720 | 1653 |
| 160 | 1762 | 1766 | 1784 | 1709 | 1596 |
| 155 | 1679 | 1679 | 1706 | 1664 | 1529 |
| 150 | 1584 | 1603 | 1612 | 1590 | 1453 |
| 145 | 1536 | 1534 | 1508 | 1496 | 1352 |
| 140 | 1454 | 1459 | 1400 | 1384 | 1242 |
| 135 | 1341 | 1352 | 1296 | 1231 | 1114 |
| 130 | 1198 | 1212 | 1195 | 1085 | 994 |
| 125 | 1041 | 1071 | 1058 | 943 | 866 |
| 120 | 894 | 893 | 894 | 793 | 708 |
| 115 | 740 | 729 | 734 | 643 | 542 |
| 110 | 582 | 570 | 573 | 486 | 407 |
| 105 | 466 | 418 | 421 | 318 | 275 |
| 100 | 342 | 311 | 294 | 176 | 143 |
| 95 | 207 | 186 | 182 | 56 | 49 |
| 90 | 90 | 91 | 82 | 19 | 19 |
| 85 | 26 | 27 | 37 | 7 | 15 |
| 80 | 30 | 8 | 15 | 0 | 11 |
| 75 | 0 | 0 | 0 | 0 | 0 |

LAMP:
2-40 W-F-T12-RS CW RATED 3300 LUMENS EACH

| LUMINAIRE DISTRIBUTION DATA | | | | | |
|---|---|---|---|---|---|
| MID-ZONE ANGLE | 0° B | 22 1/2° D | 45° C | 67 1/2° E | 90° A |
| 180 | 1673 | 1673 | 1673 | 1673 | 1673 |
| 175 | 1670 | 1673 | 1676 | 1670 | 1670 |
| 170 | 1657 | 1657 | 1657 | 1654 | 1654 |
| 165 | 1628 | 1625 | 1625 | 1615 | 1615 |
| 160 | 1586 | 1577 | 1583 | 1560 | 1573 |
| 155 | 1528 | 1517 | 1519 | 1509 | 1505 |
| 150 | 1463 | 1523 | 1451 | 1432 | 1424 |
| 145 | 1380 | 1383 | 1362 | 1338 | 1338 |
| 140 | 1280 | 1287 | 1268 | 1235 | 1231 |
| 135 | 1164 | 1182 | 1159 | 1123 | 1121 |
| 130 | 1035 | 1042 | 1037 | 1001 | 1001 |
| 125 | 883 | 899 | 899 | 885 | 875 |
| 120 | 725 | 758 | 761 | 753 | 733 |
| 115 | 551 | 586 | 594 | 586 | 591 |
| 110 | 400 | 507 | 434 | 444 | 446 |
| 105 | 267 | 287 | 289 | 293 | 297 |
| 100 | 148 | 166 | 161 | 154 | 155 |
| 95 | 45 | 54 | 51 | 48 | 48 |
| 90 | 0 | 0 | 0 | 0 | 0 |

INDIRECT LIGHTING FIXTURE WITH IMPROVED LIGHT CONTROL

BACKGROUND OF THE INVENTION

The present invention relates to lighting fixtures generally; it particularly relates to indirect lighting fixtures which illuminate a space by reflecting light off interior ceiling and wall surfaces.

The advantage of indirect lighting over direct lighting is in the ability of indirect lighting schemes to spread the light out over a larger area within a room and to do so more uniformly at a task surface whether the task surface is horizontal or vertical. Since before reaching the task area light is reflected off of a ceiling or wall surface, the light flux effectively comes to the task from a large area source equivalent to a large number of point source locations, resulting in an evenly lit task surface with minimum shadow. Indirect lighting also provides a more subtle and comfortable lighting environment by eliminating problems of glare which is the primary source of visual discomfort.

Despite its advantages, the choice of indirect lighting for space lighting presents certain disadvantages. For example, problems have existed in achieving light distribution patterns which avoid dark and/or bright spots on adjacent ceiling and wall surfaces. These problems have been addressed in applicant's copending application Ser. No. 46,950, filed June 8, 1979, wherein a unique lens design is provided to spread and more evenly distribute the fan of light from the fixture.

A further notable disadvantage of indirect lighting is psychological. It is found by the inventors that it is psychologically more pleasing for a person to have a perception of seeing the light source which produces general lighting, provided the source is not too bright. With conventional indirect lighting such a perception does not exist. This is because all the light from the light source is either directed upwardly above the horizontal plane of the fixture, or, if the light is directed below the fixture, it is directed against a wall adjacent the fixture to "wash" the wall with indirect light. In either case the person within the room is unable to locate the light source other than through wall and/or ceiling reflections.

The present invention pertains to long linear lighting fixtures, a style of fixture which generally employs fluorescent lamps as a light source but which can use other types of sources. For aesthetic reasons it is desirable to have in such a fixture a relatively small cross-sectional dimension of approximately 6 inches or less, for example, in the case of a cylindrically shaped fixture a diameter of about six inches. With significantly larger diameters the fixture becomes oversized in relation to many interior spaces in which the fixture is installed. The problem is that it is axiomatic that the smaller the dimensions of the fixture, and therefore the smaller the distances between the light emitting surfaces of the fixture lamps and the light control elements of the fixture, the more difficult it is to gain control over the distribution of light from the fixture. This control problem is acute in indirect lighting fixtures in the desirable fixture sizes above mentioned, that is, in fixtures employing conventionally sized lamps and having an overall cross-sectional dimension of approximately six inches. With indirect lighting fixtures having cross-sectional dimensions in the neighborhood of 9 inches, the problem of light control is not acute, however, the problem of visual proportion become the limiting factor.

The present invention is an indirect lighting fixture of cross-sectional dimension of approximately six inches which provides improved light control by providing the observer with a sense of seeing the source of light without introducing visual discomfort associated with direct lighting and excessive glare. Specifically, the fixture of the invention provides a perception of viewing the source of light by directing a controlled amount of light below the horizontal plane of the fixture. The invention in addition increases the overall efficiency of the indirect fixture whereby, with a given energy consumption, more light is available to meet lighting requirements. The present invention accomplishes the above objects with a fixture produced from conventional fabricating processes and with a fixture which is easily assembled and cleaned.

SUMMARY OF THE INVENTION

In accordance with the present invention, an indirect linear lighting fixture having a relatively small cross-sectional dimension of approximately six inches is comprised of a light source and light directing means for directing light from said light source both above and below the horizontal plane of said fixture. Specifically, the light directing means directs the greatest amount of light above the fixture's horizontal plane for indirect lighting and a small controlled portion of light below but near the horizontal plane. The portion of light directed below the horizontal plane is great enough to provide a perception of seeing a source of light when the fixture is viewed above eye level, yet small enough to avoid excessive brightness.

The light directing means includes side lens means which extend upwardly from opaque side wall portions of the fixture's housing so as to form a light transmitting extension of the housing. In the preferred embodiment the side lens means will extend upwardly from the housing only to a height which prevents the light source within the housing from being viewed directly when the fixture is viewed at near horizontal viewing angles; however, it is contemplated that the side lens means could further extend to partially or entirely encircle the light source for the purpose of providing a desired light distribution pattern or for the purpose of reducing the need for periodic cleaning of the fixture.

Reflector means are provided beneath the light source in the housing to direct the light from the source in a generally upwardly and sidewardly direction. The purpose of the reflector is to achieve maximum efficiency as well as desired light distribution by reflecting light back out of that portion of the fixture provided for light transmission. The light source, typically fluorescent lamps, is positioned above the reflector to a height relative to the opaque side walls of the housing which permits a small portion of the light emitted by the lamp surfaces to be directed to the desired viewing angles below the fixture's horizontal plane.

Generally, the desired light control below the horizontal is achieved by side lens means and light source position which produces a maximum average luminance in the following ranges for the following mid-zone angles of the fixture:

| Midzone Angle (Horizontal = 90°) | Maximum Average Luminance (Footlamberts) |
|---|---|
| 85° | 100–400 FL |
| 80° | 100–250 FL |
| 75° | 0–100 FL |

It is therefore an object of the present invention to provide an indirect lighting fixture of a relatively small cross-sectional dimension which provides an observer in a room illuminated by the fixture with a sense of being in a room with a visable light source, and in a room where the visable light source does not cause visual discomfort produced by excessive glare.

It is a further object of the invention to provide an indirect lighting fixture having increased efficiency as compared to conventional indirect lighting fixtures. Increases in efficiency result from elevating the light source relative to the housing thereby increasing the amount of light which leaves the fixture. In the preferred embodiment, increased efficiency also results from providing a partially open lens structure which allows lamp and ballast heat to escape and which eliminates flux absorption by the lens cover. There are also apparent increases in efficiency, in that, perceived light level is generally higher when the observer has a sense being able to locate the source of light used to illuminate a room.

Other features and advantages of the present invention will be apparent from the following description of the preferred embodiment of the invention and from the accompanying drawings.

DESCRIPTION OF THE DRAWINGS

FIG. 1 of the drawings is an end elevation cross sectional view of the indirect lighting fixture of the present invention showing the positioning of the fixture atop a wall partition.

FIG. 2 is a partial side elevation cross sectional view of the indirect lighting fixture shown in FIG. 1.

FIG. 3 is an end elevation view of the side lens means of the present invention showing the prismatic surfaces thereon.

FIG. 4 is a table showing the lens prism angles defined in FIG. 3.

DETAILED DESCRIPTION OF THE PREFERRED EMBODIMENT

Figure 5:
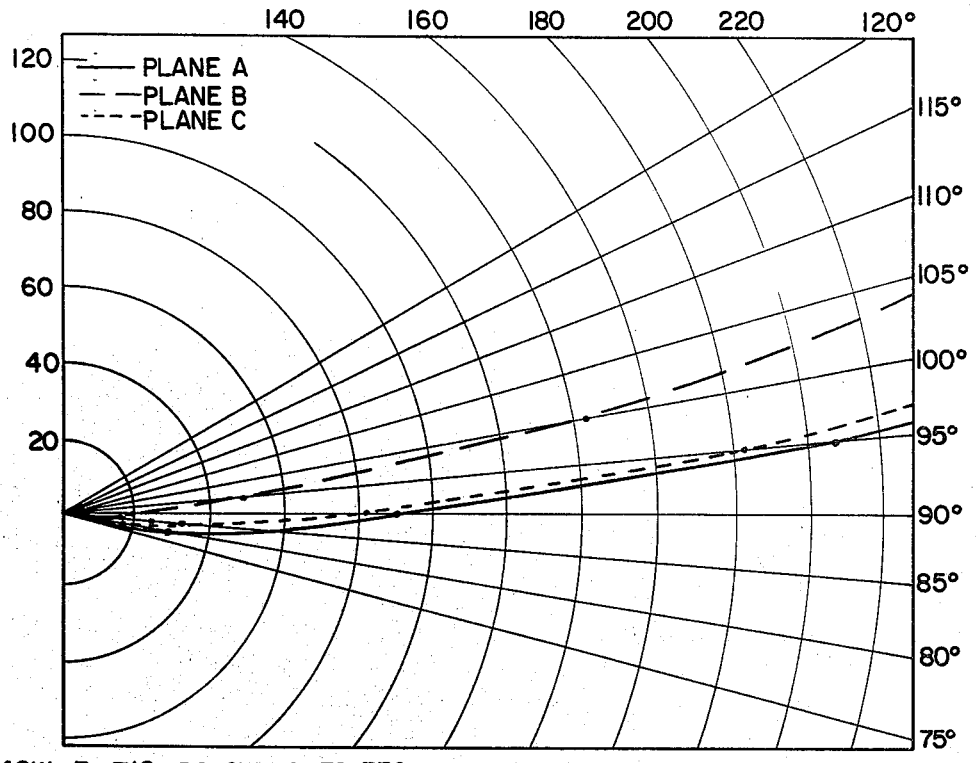
FIG. 5 is a light distribution data table and graph for an indirect light fixture made in accordance of the invention.
Figure 5:
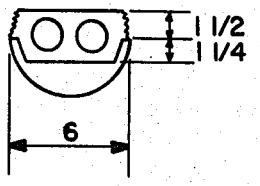
Figure 5:
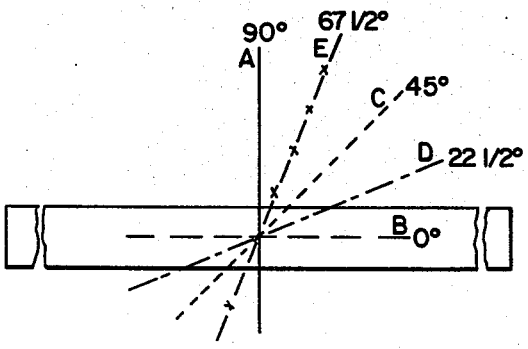

Referring now to the drawings, indirect lighting fixture 11 has an opaque housing 13, side lens means 12, 14, and reflector means 16, all of which act as a light directing means for the fixture's light source 21, 22. The housing 13 is preferably fabricated of a straight length of metal or plastic material cut to a desired length and capped at the ends, such as by the illustrated end plate 25 shown in FIG. 2. Thus, it is contemplated that the indirect lighting fixture of the present invention will be a straight elongated fixture which can, for example, be mounted to the top of a movable wall within a room, suspended from the ceiling, fixed to a wall, or secured between opposing walls. For best light distribution, it is contemplated that the fixture will be positioned approximately 2 feet below the ceiling, with the minimum effective fixture to ceiling distance being approximately 18 inches.

Reinforcement ribs 15 provide extra stiffness to the housing 13 and form a containment channel 17 for the fixture's ballast 19. Added stiffness in the housing will become especially important where the fixture is to be long in length or where the fixture will be required to support added weight, for example, by the suspension of a wall partition from the fixture.

The light source of the fixture 11 will preferably consist of standard 1½ inch diameter or smaller diameter fluorescent lamps which are removably secured in the housing by means of conventional lamp sockets, such as the illustrated lamp socket 23. The lamp sockets can be secured at the ends of the fixture to the housing end plate 25 whereby the lamps extend the full length of the fixture. In the case of long fixtures, additional lamp sockets can be mounted internally of the housing intermediate the end plates to provide for a plurality of aligned fluorescent bulbs, with the spacing between sockets being chosen to accommodate standard lamp lengths.

The laterally spaced fluorescent lamps 21, 22 seen in FIG. 1 are spaced apart equal distances from the vertical center plane of the housing. Assuming a housing of the semi-cylindrical shape shown in the drawings, and a diameter of about 6 inches, the separation between lamps should be about 2.125 inches or less. While two lamps are shown, the present invention contemplates the possible use of a single lamp (or a plurality of aligned lamps) centered in the housing; however more than two side by side conventionally sized lamps in a six inch housing would be precluded by space constrictions. Whether one centered lamp is used or two side by side lamps is largely a design choice governed the amount of overall light required. It is understood that the invention is not limited to the use of fluorescent lamps and that other suitably sized light sources can be used, for example, incandescent lamps or high-intensity discharge lamps.

It is seen that the housing 13 which is positioned beneath the lamps 21, 22 has opaque sidewall portions 27, 28 which extend from the housing's lower base portion 30 upwardly to a height denoted in FIG. 1 by the letter and number H1. The letter and number H1 will also generally define the horizontal plane of the fixture. To best achieve the objects of the invention, the lamp centers, denoted C1 and C2, should be positioned as high as possible relative to the height H1 of the sidewalls 27, 28. In the 6 inch diameter semi-cylindrical housing, it is found that a suitable placement of the lamp centers C1 and C2 of standard 1½ diameter lamps is about 0.128 inches below the side walls. Expressed in terms of the diameter of the lamps, approximately 30% to 40% of the diameter of the lamp should extend above the height H1 of the housing side walls of a 6 inch diameter housing, with the proportion preferably being approximately 35% of the diameter. This same positioning is suitable for a one lamp fixture, it being understood that the total illumination will be less with one lamp.

If the lamps 21, 22 are positioned outside the above indicated height ranges, the advantages of the present invention will rapidly diminish. For example, if the lamps are lowered relative to the housing side walls 27, 28, the perception of brightness, and thus of seeing the source of the light, diminishes, as does the actual efficiency of the fixture. If on the other hand the lamps are raised relative to the side walls, the fixture tends to become overly bright, producing the problems of glare normally associated with direct lighting. It is contemplated, however, that the lamps can be lowered significantly while retaining the fixture's photometric qualities which are described more fully below.

The illustrated reflector means 16 is secured behind lamps 21, 22 on support bracket 61, which in turn is secured internally of the housing 13 to bracket support ribs 63 by means of attachment screws 65. The reflector plate 16 is fabricated of a highly reflective metal material, such as specular aluminum, or aluminum with high and low index of refraction coatings, or silver, and can be joined to the reflector support bracket 61 by any suitable attachment means, such as the attachment screw 67 shown in the drawings.

Referring to FIGS. 1 and 2 of the drawings, the reflector 16 is shown as having three light reflecting surfaces positioned at different angles to the lamps; a bottom reflecting surface 71 is positioned in a horizontal plane beneath the lamps, and two side reflecting surfaces 73, 75 are positioned in a plane which is angled to provide an inwardly slanting reflecting surface to the side of each lamp. The bottom reflecting surface 71 reflects the light upwardly and generally through opening 33 of the light fixture whereas the angled side reflecting surfaces 73, 75 generally reflect the light in the direction of the fixture's side lenses 12, 14. A curved reflector could be used for this purpose, however, it is found that a reflector with flat reflecting surfaces is effective and can be easily fabricated by bending flat sheet material. The reflector configuration illustrated in the drawings is also best adapted to fit within the small available space within the fixture's illustrated 6 inch diameter housing.

It is noted that the fixture's ballast 19, which is wired in a conventional manner to the fixture's lamp sockets 23, can be placed behind the reflector 16 anywhere along the length of the housing 13 within the containment channel 17 defined by the housing support ribs 15. The ballast is secured in position by suitable attachment means, such as securing the ballast mounting bracket 80 by the illustrated mounting bolt 77 which is anchored in the retaining channel 78 formed in the housing base 30.

The light directing means of the invention includes, in addition to reflector 16, side lens means preferably consisting of the two shown side lenses 12, 14, which extend from the top edge 29, 31 of the housing side walls 27, 28, so as to form a light transmitting extension of the housing 13. The side lenses 12, 14 are shown as extending upwardly about the light source to a height H2. Preferably, this height will be just sufficient to achieve the object of preventing light from the light source from being viewed other than through the lenses. As hereinafter described, the light control of the side lenses will be such that an observer, whose eye level is below the height H1 of the housing side walls and who is standing at a distance from the fixture whereby the viewing angle relative to the fixture's horizontal plane is small, say less than 30°, will see just a hint of source brightness (luminance) in the lenses, enough to be able to visually locate the source.

As shown, the side lenses 12, 14 have a generally arcuate shape and are formed to lie on an approximately 3 inches radius of curvature r centered within the fixture on the axis denoted C3. Suitable height to the side lenses can be provided by extending same upwardly from the top edge 29, 31 of the housing side walls by approximately 30 degrees about the lens axis C3 along the radius of curvature r. As previously described, the illustrated housing has a generally semi-cylindrical cross sectional shape defined by the same axis C3 and the same radius of curvature r that defines the curvature of the lenses. Thus, the side lenses appear as a cylindrical extension of the side walls of the approximately six inch diameter cylindrical housing.

The above-described 30 degree extension of the lenses 12, 14, defines an opening 33 at the top of the fixture 11 which is 20 degrees of a cylinder centered at C3. Since the conversion efficiency of fluorescent lamps is heat sensitive, the increased cooling provided by the existence of opening 33 increases the over-all efficiency of the fixture as compared to a fixture whose lamps are completely or substantially completely enclosed by a lens. In addition, by minimizing the amount of lens through which light is transmitted the transmission loss associated with the lens material is reduced.

While the lighting fixture of the present invention has heretofore been described as having a straight elongated shape, it is contemplated that the concept of the present invention may be implemented by fixtures having other shapes, for example, a circular shape when seen in a top plan view. It is also contemplated that only one side lens will be required if only one side of the fixture is viewable by an observer within the room where space lighting is being provided. This would be the case, for example, where the fixture is mounted close to a vertical wall for reflecting light off the ceiling or close to the ceiling for reflecting light off the wall.

Referring now to FIG. 3, it is noted that the side lenses 12, 14 include an inwardly projecting support base 37, which extends laterally of the lense for the entire length thereof. Projecting downwardly from the support base 37 is a locking rib 39 formed to be received by corresponding retaining slots 41, 42 formed in the support ridges 43, 44 found at the top edges 29, 31 of the housing side walls, 27, 28. By use of tinnerman clips 45 and by inserting the locking ribs of the lenses into the respective retaining slots 41, 42 until the support bases 37 of the lenses firmly butt against the side wall support ridges 43, 44, the side lenses 12, 14 can be firmly but removably secured in place to the housing side walls. Removal of the lenses from the housing will be required to access the fixture for cleaning. And cleaning will periodically be required to keep the lamp, lenses and reflector surfaces free of dust and other debris which would impair the fixture's efficiency.

Referring again to FIG. 3, which illustrates a side lens used with the approximately six inch diameter cylindrical fixture, it is seen that the side lenses 12, 14 have a prismatic surface, generally denoted as 51, which acts to bend incident light so as to direct same substantially laterally of the fixture 11 in a substantially horizontal plane roughly located at the height H1 of the housing side walls. As illustrated, the prismatic surface 51 is formed on the interior surface of the lens to prevent dust accumulation and to facilitate cleaning and is comprised of a plurality of longitudinally extending substantially right angle prisms, P1 through P13, each of which are defined by a refractive surface 53 and a riser surface 55. The riser surfaces of prisms P1 through P13 fall on substantially equally spaced planes 56 radially extending from the center, C3, of the lens. As to the angles of the refractive surfaces 53 of the prisms, these angles gradually vary from an approximate vertical orientation with respect to the fixture 11 (prism P1) to an angle of approximately 60 degrees from vertical (prism P13). The exterior surface 57 of the lenses 12, 14, are seen as extending in a smooth curved surface from the top of the lens 59 to the bottom of the lens support base 37.

The lenses 12, 14 are preferably fabricated of clear virgin acrylic plastic and a suitable thickness measured from the base 64 of the prismatic surface to the exterior surface 57 is approximately 0.125 inches. The prism angles A and B as defined in FIG. 3 of the drawings are preferably chosen in accordance with the prism angle chart of FIG. 4. It is noted that the prism angles A and B are the angles between the refractive surface 53 of each prism and the prism's riser surface 55. The approximate width of each prism, that is, the distance between riser surfaces 55 of adjacent prisms, is preferably chosen to be approximately 0.125 inches, with the lens, which is centered at C3, having a radius of curvature r of approximately b 3 inches.

Figure 6:
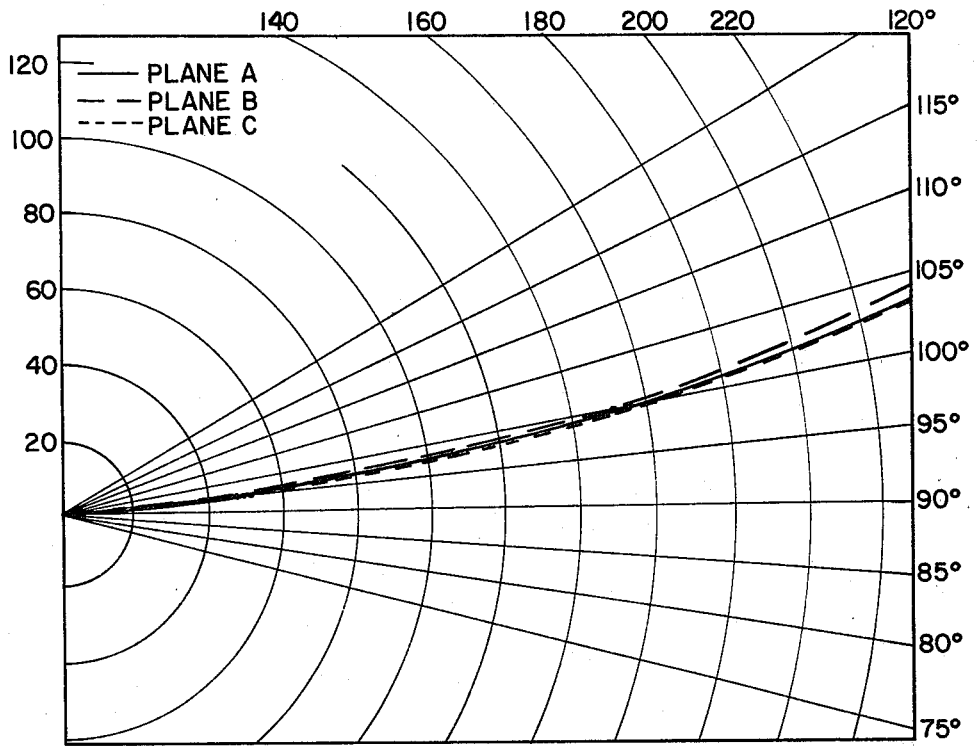
FIG. 6 is a light distribution data table and graph for a conventional indirect lighting fixture.
Figure 6:
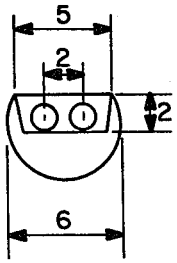
Figure 6:
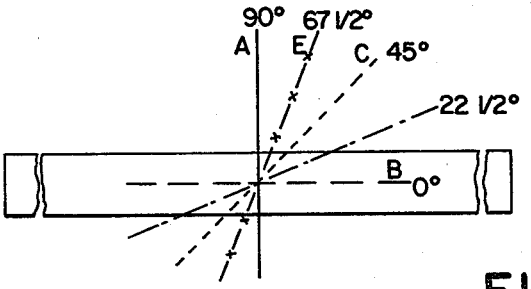

FIGS. 5 and 6, respectively, show a measured light distribution pattern for an indirect lighting fixture made in accordance with the present invention and a measured distribution pattern for a conventional indirect lighting fixture. In both FIGS. 5 and 6 the light distribution data is set forth in tabular form and a portion of the tabulated data is graphically presented on a polar graph to illustrate comparative light distributions in the regions close to and below the horizontal plane H1 of the fixture. In the tables and graphs of FIGS. 5 and 6 the horizontal plane is defined by the mid-zone angle of 90 degrees. The tables tabulate light distribution in candelas (a measure of luminous intensity) over a full range of vertical plane (mid-zone) angles for the different horizontal plane angles 0°, 22½°, 45°, 67½°, and 90°; these horizontal plane angles are defined, as is the relative lamp and housing configuration of the fixtures tested, in the schematic diagrams associated with each figure. Other pertinent testing data are also provided in the figures, for example, lamp and reflector ratings. Each fixture was tested using the side lenses defined in FIGS. 3 and 4.

It is seen from FIG. 5 that a small portion of light from the fixture of the invention is directed below the horizontal plane of the fixture whereas in the case of the conventional design shown in FIG. 6 no light is directed at or below the horizontal plane. As above described, it is the object of the invention to provide for directing light in this region so that an observer viewing the fixture at normal viewing angles will see enough "direct" light to actually perceive the location of the light source but not so much light as to cause excessive brightness and associated visual discomfort. Generally, it is found that to achieve this object a maximum average luminance or photometric brightness in the mid-zone angles between about 75° and 85° should be in the following luminance ranges:

| Midzone Angle (Horizontal = 90°) | Maximum Average Luminance (Footlamberts) |
|---|---|
| 85° | 100–400 FL |
| 80° | 100–250 FL |
| 75° | 0–100 FL |

The above angles, which relative to the fixture's horizontal plane would be viewing angles of 15°–25°, would approximately encompass the normal (though not necessarily only) viewing angles at which a fixture suspended one and one-half to two feet from an eight foot ceiling would be seen by a person standing at a distance where the fixture would normally be in the person's view. It should be noted that, at the horizontal, the luminance may be permitted to considerably exceed 400 footlamberts since an indirect fixture suspended above eye level would not normally be viewed from this viewing angle. Below about the 75° to 80° mid-zone angles the luminance can normally be expected to fall off very rapidly to zero. These lower mid-zone angles would represent high viewing angles (greater than 25°) relative to horizontal, which means without looking up the fixture begins to be positioned substantially out of view.

To interpret the data of the FIG. 5 and to better understand the photometric concepts of the invention, mention is here made of the photometric units of measure used herein. "Footlamberts" is a measure of luminance of the light source when viewed from any particular direction. When viewed from a fixed direction the brightness of the source may actually vary over the surface of the source, for example, due to a prismatic lens surface which creates a strippled effect of bright and dark surfaces within the lens. The present invention is therefore defined in terms of "average luminance" at mid-zone angles below horizontal, which means when viewed from a particular direction the differences in observed surface brightness are averaged to provide an overall luminance at that viewing point as defined by a mid-zone and horizontal plane angle. The "average luminance" of a fixture viewed at any direction can be determined from the measured photometric intensity (candelas) from the following equation:

$$L = \frac{I \times \pi}{A}$$

where L is the average luminance in footlambers, I is the measured photometric intensity expressed in candelas, and A is the "projected area" in square feet for the fixture in the direction for which luminance is being determined. The table below shows the measured photometric intensity, projected area, and average luminance for the maximum candela measurements within each of the mid-zone angles of 75°, 80°, 85°, 90°, and 95° for the light distribution pattern shown in FIG. 5.

| Mid-Zone Angle | Max Candela Amount For All Measured Horizontal Angles | Approx. Projected Area (square feet) | Max Average Luminance (footlamberts) |
|---|---|---|---|
| 95° | 207 | .47 | 1383 |
| 90° | 91 | .47 | 608 |
| 85° | 37 | .33 | 352 |
| 80° | 30 | .46 | 204 |
| 75° | 0 | .45 | 0 |

From the above data it is seen that the maximum average luminance of the illustrated fixture at the near horizontal mid-zone angles of 80° and 85° is respectively, 204 and 352 footlamberts; at 90° the luminance increases markedly to 608 footlamberts whereas at 75° it drops to zero. Also, it is seen from FIG. 5 that at the 80° and 85° mid-zone angles the light intensity and hence luminance vary with the horizontal angle; while perhaps ideally the brightness would be substantially uniform for all horizontal angles at a given mid-zone angle, this is in practice not possible, nor is it necessary to achieve the objects of the invention. Rather, in accordance with the invention, the light directing means of the fixture is designed so that the maximum luminance at the desired viewing angle falls substantially within the upper and lower brightness limits.

It is understood that the invention can be embodied in fixture configurations other than schematically shown in FIG. 5, for example, a fixture having an oval or square cross-section having an average cross-sectional dimension of approximately 6 inches, however, the FIG. 5 fixture configuration and resultant light distribution pattern is exemplary of a fixture wherein the above stated objects can be achieved.

Therefore, it is seen that the present invention is an improved indirect lighting fixture having a relatively small cross-sectional dimension which provides relatively improved efficiency and the psychological advantage of providing the observer with a sense of being able to observe the source of the indirect light produced by the fixture without the visual discomfort associated with glare. The indirect lighting fixture of the present invention is a balance between the advantages of direct lighting and indirect lighting, a balance which is primarily achieved by the positioning the light source within a fixture's opaque housing and by lens control of the laterally directed light emitted from the fixture. Although the invention has been described in considerable detail in the foregoing specification, it is not intended that the invention be limited to such detail, except as necessitated by the following claims.

We claim:

1. An indirect lighting fixture having a cross-sectional dimension of approximately 6 inches comprising a light source, an opaque housing having opaque side wall portions which extend upwardly from beneath said light source, side lens means attached to the opaque side wall portions of said housing and extending upwardly therefrom to form a light transmitting extension thereof, said side lens means being formed to receive light from said light source and direct same substantially laterally of said fixture such that the greatest portion of the light travelling through said lens is directed above said horizontal plane and a small portion of the light travelling through said lens is directed below said horizontal plane, said portion of light directed below said horizontal plane of said fixture being great enough to provide a perception of seeing a light source when an observer views the fixture above but near eye level and small enough to avoid excessive brightness, said light source being vertically elevated within said housing relative to the side walls thereof a sufficient distance to permit a small portion of light emanating from the light source to be directed below said horizontal plane by said side lens means, and reflector means in said housing beneath said light source for reflecting light therefrom generally upwardly so as to increase the amount of light directed out of said fixture.

2. The indirect lighting fixture of claim 1 wherein said side lens means extends upwardly about said light source to a height which prevents said light source from being viewed directly when said fixture is viewed at a substantially horizontal viewing angle.

3. The indirect lighting fixture of claim 2 wherein said side lens means is arcuate and is formed to lie on radius of curvature centered on an axis within said fixture.

4. The indirect lighting fixture of claim 3 wherein said side lens means has a light bending prismatic surface located on the interior surface thereof to facilitate cleaning, said prismatic surface being comprised of a plurality longitudinally extending substantially right angle prisms having prism angles substantially defined in accordance with the Table in FIG. 4 of the drawings.

5. The indirect lighting fixture of claim 4 wherein said opaque housing is fabricated of a straight length of extruded material cut to a desired length and wherein said extruded housing has a substantially semi-circular cross-section approximately 6 inches in diameter having substantially the same radius of curvature as said side lens means.

6. The indirect lighting fixture of claim 5 wherein said light source is comprised of one fluorescent lamp centered within said housing.

7. The indirect lighting fixture of claim 5 wherein said light source is comprised of two laterally spaced fluorescent lamps.

8. The indirect lighting fixture of claim 5 wherein the top ends of said side lens means define a top opening in said fixture whereby light is directed upwardly from said fixture through said opening as well as through said lens means thereby reducing transmission losses and increasing ventilation.

9. An indirect lighting fixture comprising a light source, an elongated, substantially cylindrical opaque housing having an approximately 6 inch diameter and having opaque lengthwise side wall portions which extend upwardly from beneath said light source, arcuate and elongated side lens means attached to the opaque side wall portions of said housing and extending upwardly therefrom to a height which prevents said light source from being viewed directly when said fixture is viewed above eye level, said side lens means being formed to lie on a substantially common radius of curvature having its center within said housing substantially midway between said housing side wall portions and formed to provide a light transmitting extension of said side wall portions, said side lens means being formed to receive light from said light source and direct same substantially laterally of said fixture such that the greatest portion of the light travelling through said lens is directed above and close to said horizontal plane and a small portion of the light travelling through said lens is directed below but near said horizontal plane, said portion of light directed below said horizontal plane of said fixture being great enough to provide a perception of seeing a light source when an observer views the fixture substantially at or above eye level and small enough to avoid excessive brightness, and said light source being vertically elevated within said housing relative to the side walls thereof a sufficient distance to permit a small portion light emanating from the light source to be directed below said horizontal plane by said side lens means, and reflector means in said housing behind said light source for reflecting light therefrom generally upwardly so as to increase the amount of light directed out of said fixture.

10. The indirect lighting fixture of claim 9 wherein said arcuate side lens means extends upwardly along its curvature by approximately 30 degrees.

11. The indirect lighting fixture of claim 1 or 10 wherein said light source includes two fluorsecent lamps each having a diameter of approximately 1.5 inches or less and spaced apart approximately 2.125 inches or less.

12. The indirect lighting fixture of claim 3 or 9 wherein the center of the radius of curvature for said side lens means lies on a lens axis aligned with the top of the side wall portions of said opaque housing and wherein the lamp axis for said fluorescent lamps is located approximately 0.218 inches below said lens axis.

13. The indirect lighting fixture of claim 1 or 9 wherein said light source is comprised of at least one fluorescent lamp having a diameter of 1½ inches or less, and wherein said fluorescent lamp is elevated such that between 30 and 40 percent of its diameter projects above the opaque side wall portions of side housing.

14. The indirect lighting fixture of claim 13 wherein approximately 35° of the diameter of said lamp projects above the opaque side walls of said housing.

15. The indirect lighting fixture of claim 13 wherein said light source is comprised of two laterally spaced fluorescent lamps.

16. The indirect lighting fixture of claim 14 wherein said light source is comprised of two laterally spaced fluorescent lamps.

17. The indirect lighting fixture of claim 7 wherein said side lens means has a light bending prismatic surface located on the interior surface thereof to facilitate cleaning, said prismatic surface being comprised of a plurality longitudinally extending substantially right angle prisms having prism angles substantially defined in accordance with the Table in FIG. 4 of the drawings.

18. The indirect lighting fixture of claim 1, 3, or 9, wherein wherein said light source is vertically elevated and said side lens means is formed to provide the following maximum average luminance below the fixture's horizontal plane for mid-zone angles of 75°, 80° and 85°: for 85° approximately 100 to 400 footlamberts; for 80° approximately 100 to 250 footlamberts; for 75° approximately 0 to 100 footlamberts.

* * * * *

UNITED STATES PATENT AND TRADEMARK OFFICE

CERTIFICATE OF CORRECTION

PATENT NO. : 4,390,930

DATED : June 28, 1983

INVENTOR(S) : Douglas J. Herst and Peter Y.Y. Ngai

It is certified that error appears in the above—identified patent and that said Letters Patent is hereby corrected as shown below:

Col. 6, line 11, "20" should be --120--.

Signed and Sealed this

*Twentieth* Day of *March 1984*

[SEAL]

*Attest:*

GERALD J. MOSSINGHOFF

*Attesting Officer*

*Commissioner of Patents and Trademarks*